United States Patent [19]

Jamerson

[11] 4,060,901

[45] Dec. 6, 1977

[54] TEMPLATE FOR LINING SHEET MUSIC PAPER

[76] Inventor: Donald W. Jamerson, 4120 N. Belmont, Kansas City, Mo. 64117

[21] Appl. No.: 710,646

[22] Filed: Aug. 2, 1976

[51] Int. Cl.[2] ..... B43L 13/02

[52] U.S. Cl. ..... 33/108; 33/41 B

[58] Field of Search ..... 33/108, 41 BR, 174 B, 33/174 G; 35/37, 38

[56] References Cited

U.S. PATENT DOCUMENTS

| | | | |
|---|---|---|---|
| 564,204 | 7/1896 | Leeds | 33/108 |
| 1,426,055 | 8/1922 | Fast | 35/38 |
| 1,839,561 | 1/1932 | Kaufman | 33/108 |
| 2,983,049 | 5/1961 | Andrisani | 33/184.5 |
| 3,226,838 | 1/1966 | Courrege et al. | 33/184.5 |
| 3,905,117 | 9/1975 | Walton | 33/174 B |

*Primary Examiner*—Richard E. Aegerter
*Assistant Examiner*—John W. Shepperd
*Attorney, Agent, or Firm*—Lowe, Kokjer, Kircher, Wharton & Bowman

[57] ABSTRACT

A template provides assistance in the lining of sheet music paper. Closely spaced, parallel slots are formed through the template to guide a writing instrument in drawing the lines. Adjustable guides are attached to the template beside the slots to indicate where the lines for each staff are to be drawn.

11 Claims, 7 Drawing Figures

TEMPLATE FOR LINING SHEET MUSIC PAPER

BACKGROUND AND SUMMARY OF THE INVENTION

This invention relates to a template which is used to prepare lined sheet music paper.

Musicians and others who work with sheet music often encounter the need to line blank paper in order to prepare sheet music paper. Such lining is difficult to accomplish with an ordinary straight edge because the staff lines must be drawn rather closely together and parallel. Also, the staffs must often be separated from one another in relatively uniform fashion to provide adequate space for lyrics to be written in between each pair of staffs.

U.S. Pat. No. 3,905,117 to Walton shows one type of stencil device that may be used to prepare sheet music paper. The stencil must be slid along a straight edge to guide a writing instrument in marking the staff lines, and it is thus difficult to draw the lines accurately. In addition, the number of lines contained in each staff is not variable, nor is the spacing between adjacent staffs. Therefore, this type of stencil device is useful only in preparing sheet music which has a given number of lines per staff and a preset spacing between staffs. Also, when the lines are to be marked in ink, the sliding of the stencil causes smearing of the ink to an unacceptable extent. Plastic templates are generally unsatisfactory because the plastic strips between the slots are so narrow and weak that they are unable to withstand the pressure of a pen or pencil without moving and thus causing inaccurate lines to be drawn.

It is the primary goal of the present invention to provide an improved template for use in lining sheet music paper.

More specifically, it is an object of the invention to provide a template that presents a plurality of closely spaced slots in which the staff lines may be quickly and accurately drawn.

Another object of the invention is to provide a template that is constructed of metal to enhance the strength of the narrow strips between the slots.

A further object of the invention is to provide a template that includes adjustable guides for indicating the locations at which the staff lines are to be drawn.

In conjunction with the preceding object, it is yet another object of the invention to provide a template in which guides of various lengths are included for the drawing of staffs having various numbers of lines.

An additional object of the invention is to provide a template of the character described wherein the guides may be quickly and easily attached, detached, and adjusted in position.

A still further object of the invention is to provide a template of the character described that is constructed economically yet durably.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
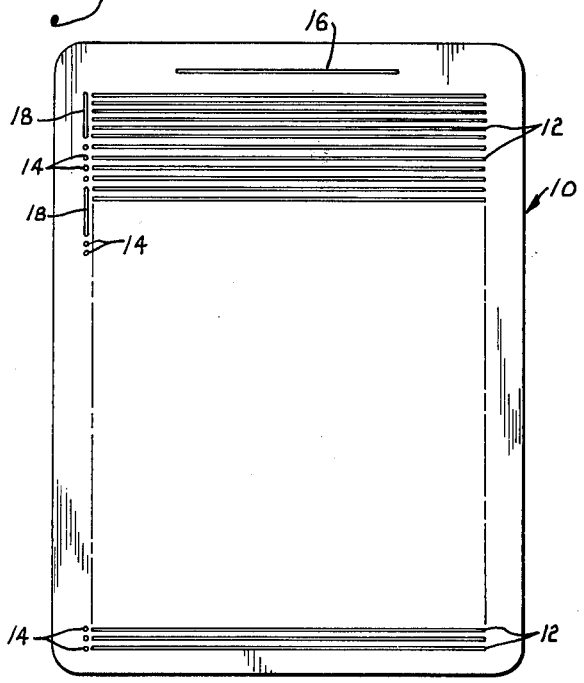
FIG. 1 is a top plan view of a template constructed according to a preferred embodiment of the invention, with the broken lines indicating that the slots extend continuously throughout substantially the entirety of the template.
Figure 2:
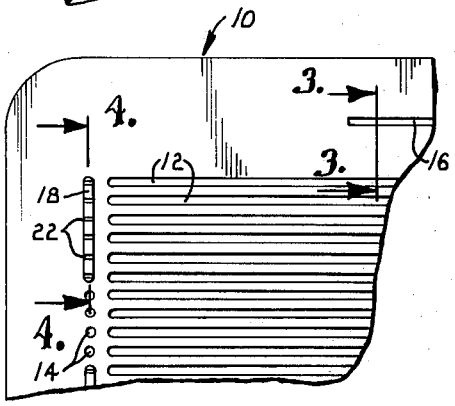
FIG. 2 is a fragmentary plan view on an enlarged scale of the upper left hand portion of the template shown in FIG. 1.

Referring now to the drawing in greater detail and initially to FIG. 1, a template constructed according to the present invention is generally designated by reference numeral 10. The template is a thin flat plate which is generally rectangular, although its corners and all edges are rounded for safety. Template 10 is constructed of metal and is steel in the preferred embodiment.

Figure 3:
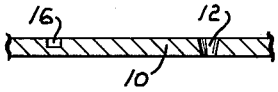
FIG. 3 is a fragmentary cross sectional view on an enlarged scale taken generally along line 3—3 of FIG. 2 in the direction of the arrows.

A plurality of narrow, parallel slots 12 are formed through template 10 across most but not all of its width. The slots terminate somewhat inwardly of each side edge of the template. Slots 12 are spaced uniformly apart from one another throughout substantially the entire length of the template. The spacing between adjacent slots is approximately .2cm. to conform with the normal spacing between adjacent staff lines of sheet music paper. As best shown in FIG. 3, each slot 12 is tapered from top to bottom in order to conform generally with the shape of a pen or pencil tip (not shown). The size of each slot is such that the pen or pencil tip will fit closely therein.

A plurality of small holes 14 are formed through template 10 in a straight row which extends along the left portion of the template slightly beyond the left end of the slots 12. The row of holes 14 is perpendicular to the slots and there is one hole 14 located beyond the left end of each slot 12.

A groove 16 which is parallel to slots 12 is formed between the top edge of template 10 and the uppermost slot 12. As shown in FIG. 3, groove 16 does not extend completely through the template. The groove is sized to closely receive the edge of a clip such as that of a clip board (not shown), as will be explained in greater detail.

Figure 4:
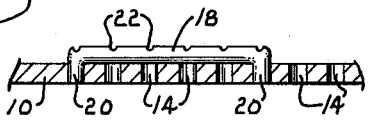
FIG. 4 is a fragmentary sectional view on an enlarged scale taken generally along line 4—4 of FIG. 2 in the direction of the arrows.

A plurality of adjustable guides 18 are provided to indicate the locations at which the staff lines are to be drawn. As shown in FIG. 4, each guide 18 is a straight wire member having opposite ends 20 which are bent at right angles. The ends 20 are able to fit closely into the holes 14 to assist in attaching the guides 18 to the top surface of the template. The guides are preferably magnetized so that they will be magnetically attracted to the steel template for mounting thereon.

The guides 18 which are illustrated in the drawing are long enough to span the distance between six slots 12.

When the guides are attached to the template, the opposite ends 20 are therefore received in holes 14 that are spaced six holes apart, with four additional holes lying beneath the guide 18. Six small notches 22 (FIG. 4) are formed in the top of each guide 18 at locations corresponding to the six holes 14 which the guide spans. Each notch 22 is colored or otherwise marked so that the number of notches in the guide may be readily ascertained.

Additional sets of guides (not shown) are also provided. The additional guides are constructed similarly to guides 18, but each set is shorter or longer than guides 18 so as to span four, five, or seven holes. Marked notches are formed in these additional guides to indicate the number of holes 14 which each is able to span.

In use, guides 18 are attached to template 10 if the staffs to be drawn are each to have six lines. Thus, guides 18 are used when staffs in tablature form are to be drawn, for example. The ends 20 of the guides are inserted in selected holes 14 to position the guides at the desired locations on the template, with the magnetic attraction firmly holding the guides in place. The guides may be spaced apart from one another as desired to provide adequate room for lyrics to be written in between each pair of staffs.

With guides 18 in place, template 10 is placed on top of a sheet of blank paper (not shown), and the template and paper are together placed on a hard surface such as that of a clip board (also not shown). Groove 16 receives the clip edge to prevent relative movement between the template, paper, and clip board. It is also contemplated that thin strips of rubber or the like (not shown) will be interposed between the template and paper to prevent sliding or other movement of the paper. These strips may be incorporated in the underside of the template 10 or glued thereto. A pen or pencil is then inserted in each slot 12 which is beside one of the guides 18, and the marking instrument is moved the length of the slot to mark a straight staff line on the underlying paper. After the writing instrument has marked through all of the appropriate slots 12, a plurality of six line staffs will have been marked on the paper, with the staffs separated from one another according to the spacing between the guides 18. In this manner, lined sheet music paper is prepared with the staff lines accurately drawn parallel to one another and in the desired spacial arrangement.

The additional sets of guides (not shown) are used in place of guides 18 when it is desired to mark staffs of four lines (bass guitar), five lines (ordinary sheet music), or seven lines (seven string guitar). Guides having different lengths may also be used for the same sheet of paper if staffs having different numbers of lines are to be drawn on the sheet. In all cases, the adjustability of the guides permits them to be separated sufficiently to provide adequate room for lyrics to be written in between the adjacent staffs. The number of marked notches 22 in each guide may be easily counted to determine the number of staff lines for which the guide is useful. Alternatively, it is contemplated that the different sets of guides may be color coded so that the set to which each guide belongs may be determined even more easily.

Figure 5:
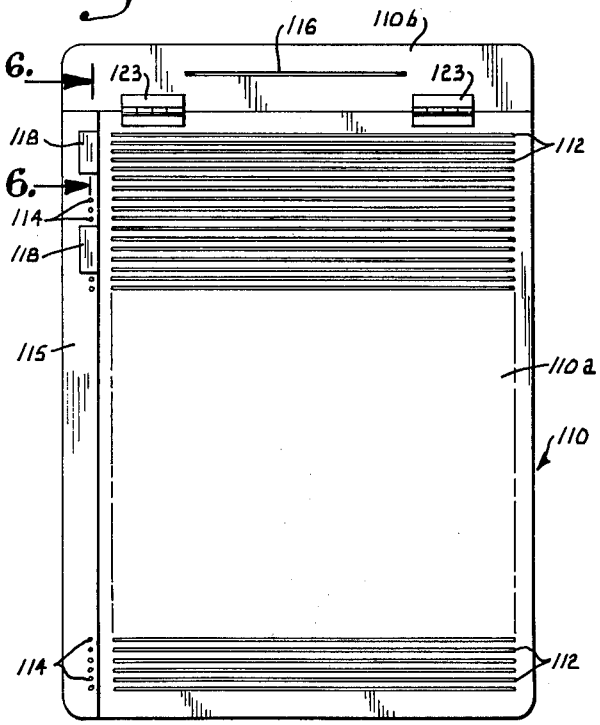
FIG. 5 is a plan view of a template constructed according to a second embodiment of the invention, with the broken lines indicating that the slots extend continuously the entirety of the template.
Figure 6:
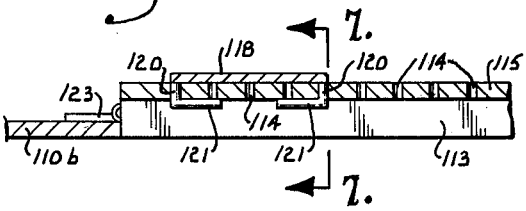
FIG. 6 is a fragmentary cross sectional view on an enlarged scale taken generally along line 6—6 of FIG. 5 in the direction of the arrows.
Figure 7:
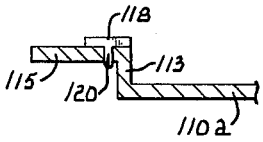
FIG. 7 is a fragmentary cross sectional view taken generally along line 7—7 of FIG. 6 in the direction of the arrows.

FIGS. 5–7 illustrate an alternative template 110 which is similar to template 10 in most respects. One difference is that the portion of template 110 to the left of its slots 112 is bent upwardly at a right angle as indicated at 113 in FIGS. 6 and 7. A flange 115 is bent at 90° from the edge of portion 113, and the flange thus lies in a plane parallel to and offset above the rest of the template 110.

Holes 114 which assist in mounting guides 118 are formed in flange 115 in a straight row which extends perpendicular to the slots 112. One hole 114 is provided for each slot 112.

The guides 118 which are used with template 110 may be constructed somewhat differently than the guides 18 illustrated in FIGS. 1–4. Guides 118 have rather wide bodies from which opposite wire ends 120 project at right angles. To secure the guides firmly in place on flange 115, the ends 120 are inserted through holes 114 and are bent along the underside of the flange as indicated at 121 in FIG. 6.

Template 110 is constructed with a body portion 110a in which the slots 112 are formed, and an upper portion 110b in which the groove 116 is formed to receive the clip of a clip board (not shown). Portions 110a and 110b of the template are connected by a pair of hinges 123 which permit the two template portions to move relative to one another in hinged fashion, as will be explained in more detail.

The template 110 shown in FIGS. 5–7 is used in substantially the same manner as described earlier in connection with template 10. The offset flange 115 provides adequate clearance of the guide ends 120 from the paper which is being lined. Also, due to the offset location of the flange, the ends 120 may be easily unbent and withdrawn from holes 114 to remove the guides 118 from the template. Although the guides 118 illustrated in the drawing each span five of the holes 114, it is to be understood that additional sets of guides (not shown) are provided for use in drawing staffs containing four, six, or seven staff lines. Again, the guides may be marked or color coded to indicate the number of holes they are able to span.

The hinged connection between the body portion **110*a* and the upper holding portion 110*b* permits sheets of paper to be easily inserted and removed. The clip edge of the clip board (not shown) is received in the groove 116 to hold the template down against the clip board surface. After a sheet of paper has been lined, the body 110*a* is raised about the hinges 123 so that the lined paper may be easily removed without requiring the template to be detached from the clip board. A second sheet of paper is then inserted beneath the raised body 110*a*, and the body is lowered on top of the paper which is thereafter lined in the manner described above. It is contemplated that the embodiment shown in FIGS. 1–4** may also be constructed in a pair of hingedly connected sections in order to facilitate the insertion and removal of paper.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A template device for use in marking a plurality of closely spaced lines arranged in a plurality of spaced apart groups each containing a preselected number of lines, said device comprising:

a template presenting a plurality of substantially parallel slots each adapted to receive and guide a marking instrument, said slots being spaced closely and substantially uniformly apart from one another;

a plurality of guides for indicating separate groups of slots, said guides each having a length to substantially span said preselected number of slots; and means for attaching said guides releasably to said template at locations spaced apart from one another with each guide substantially spanning a group of slots containing said preselected number of slots, whereby the group of slots indicated by each guide may be spaced apart from the groups of slots indicated by the other guides.

2. A device as set forth in claim 1, including a plurality of marks on each guide indicating the number of slots the guide is able to span.

3. A device as set forth in claim 1, wherein each slot is tapered in shape to facilitate insertion of a marking instrument therein.

4. A device as set forth in claim 1, wherein said attachment means comprises magnetic means.

5. A device as set forth in claim 4, wherein said template is ferromagnetic and said guides are magnetized members.

6. A device as set forth in claim 1, wherein said attachment means includes a plurality of openings formed in said template in a row extending generally alongside one end of each slot, said guides having opposed end portions each adapted to closely fit in said openings to attach the guides to said template.

7. A device as set forth in claim 6, wherein said template is ferromagnetic and said guides are magnetized members for attraction to the template.

8. A device as set forth in claim 6, wherein one opening is formed for each slot at a location in proximity to said one end thereof, and including a plurality of marks on each guide at locations thereon corresponding with the locations of the openings over which the guide is able to extend.

9. A device as set forth in claim 1, including a flange portion of said template located beyond one end of each slot in a plane offset from that of the remainder of the template, said attachment means mounting said guides to said flange portion.

10. A device as set forth in claim 9, wherein said attachment means comprises a plurality of openings formed through the flange portion of said template in a substantially straight row, said guides each having a pair of wire ends adapted to fit through said openings to attach said guides to said flange portion.

11. A device as set forth in claim 1, wherein said template includes:

a body portion in which said slots are formed;

a holding portion having means for receiving a holding device to hold the template in place; and hinge means for hingedly coupling said body portion to said holding portion.

* * * * *